US006176279B1

(12) United States Patent
Dahlin et al.

(10) Patent No.: US 6,176,279 B1
(45) Date of Patent: Jan. 23, 2001

(54) LOCOMOTIVE SERVICING METHOD AND VEHICLE

(75) Inventors: William G. Dahlin; William S. Pladson, both of Fargo, ND (US)

(73) Assignee: M-Bar-D Railcar Tech., Inc., Fargo, ND (US)

( * ) Notice: Under 35 U.S.C. 154(b), the term of this patent shall be extended for 0 days.

(21) Appl. No.: 09/409,676

(22) Filed: Sep. 30, 1999

Related U.S. Application Data

(60) Provisional application No. 60/105,552, filed on Oct. 26, 1998.

(51) Int. Cl.[7] ..... B67D 5/00

(52) U.S. Cl. ..... 141/231; 141/2; 141/104; 222/608; 137/899; 137/234.6; 137/355.12; 137/351; 280/838; 280/839

(58) Field of Search ..... 141/1, 2, 18, 21, 141/98, 104, 231; 137/234.6, 345, 346, 351, 355.12, 899; 222/608, 626, 627; 280/837–839

(56) References Cited

U.S. PATENT DOCUMENTS

| | | | | |
|---|---|---|---|---|
| 2,498,229 | * | 2/1950 | Adler | 222/626 |
| 3,032,079 | * | 5/1962 | Lisciani | 141/231 |
| 3,814,148 | * | 6/1974 | Wostl | 141/98 |
| 5,873,498 | * | 2/1999 | Moore et al. | 222/181.2 |

* cited by examiner

*Primary Examiner*—J. Casimer Jacyna
(74) *Attorney, Agent, or Firm*—Burd, Bartz & Gutenkauf

(57) ABSTRACT

A motor truck has a frame supporting a fuel tank, an oil tank and a water tank along with a container for sand for servicing a rail locomotive located at a remote location or rail yard. Pumps mounted on the frame move the fuel, oil, and water from the tanks through hoses to tanks on the locomotive. A hoist on the truck moves the sand container from the truck to a location adjacent the locomotive to allow sand to flow into a sand hopper on the locomotive.

18 Claims, 6 Drawing Sheets

LOCOMOTIVE SERVICING METHOD AND VEHICLE

CROSS REFERENCE TO RELATED APPLICATION

This application claims the benefit of the filing date of U.S. Provisional Patent Application Ser. No. 60/105,552 filed Oct. 26, 1998.

FIELD OF THE INVENTION

The invention is in the field of mobile equipment for servicing rail locomotives with fuel, sand, oil, and water. The mobile equipment comprises a motor vehicle or truck having fuel, water, oil, and sand accommodating tanks and pumps to transport fuel, water, and oil to a locomotive at a remote location or rail yard.

BACKGROUND OF THE INVENTION

Railroad locomotives have large diesel engines that utilize substantial amount of diesel fuel, oil, and water. Sand is also used to improve the traction of the drive wheels of the locomotive on the tracks. When a locomotive requires fuel, it is common practice to cut the locomotive from the train cars and run it to a service pit. This takes time and increases the cost of rail services. The locomotive fuel truck of the invention provides all of the essential fuel, water, oil, and sand requirements for a locomotive without the need to cut and run the locomotive to a service pit.

SUMMARY OF THE INVENTION

The invention is a method and apparatus for servicing a railroad locomotive with fuel, oil, water, and sand with efficient, safe and cost-effective mobile equipment. The locomotive can be serviced in remote locations or in the yard without the need to cut and run the locomotive to a service pit. This method of servicing a locomotive saves time, labor, and cost of railroad services.

The mobile equipment comprises a motor truck or lorry having a frame carrying tanks for storing diesel fuel, oil, water, and sand. Pumps mounted on the truck transfer fuel, oil, and water from the tanks to transfer hoses that carry the fuel, oil, and water to the locomotive. The controls for the pumps include ON-OFF valves and meters that measure the amount of fuel dispensed to the locomotive. Air under pressure from the locomotive air reservoir flows through a hose to the truck. The flowing air is used to transport sand from a tank or container on the truck to a sand hopper on the locomotive. An alternative method of delivering sand to the locomotive uses a hoist or crane mounted on the frame to lift a sand tank to a position adjacent the locomotive to allow sand to flow into a sand hopper on the locomotive. Fuel and oil spill response equipment on the truck is used to clean the environment in the event that there is a fuel or oil spill.

DETAILED DESCRIPTION OF THE INVENTION

Figure 1:
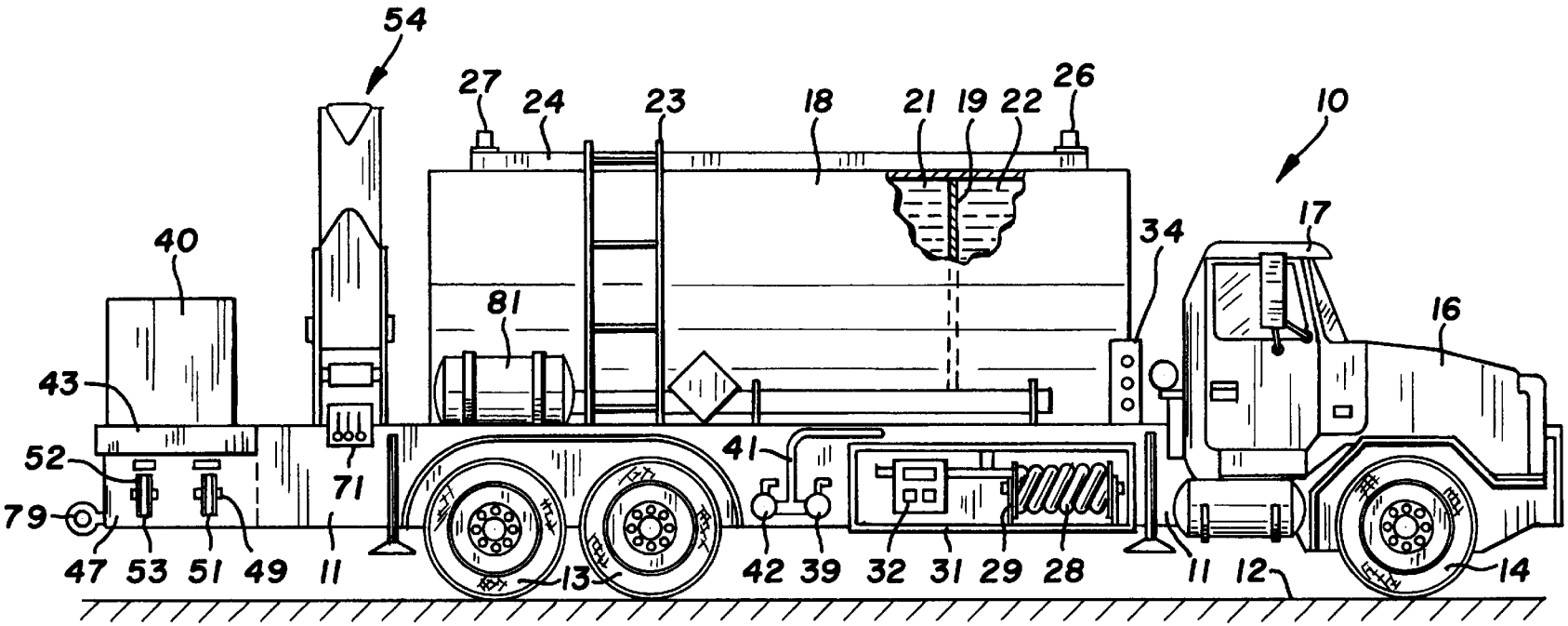
FIG. 1 is a right side elevational view of a rail locomotive service truck of the invention.
Figure 2:
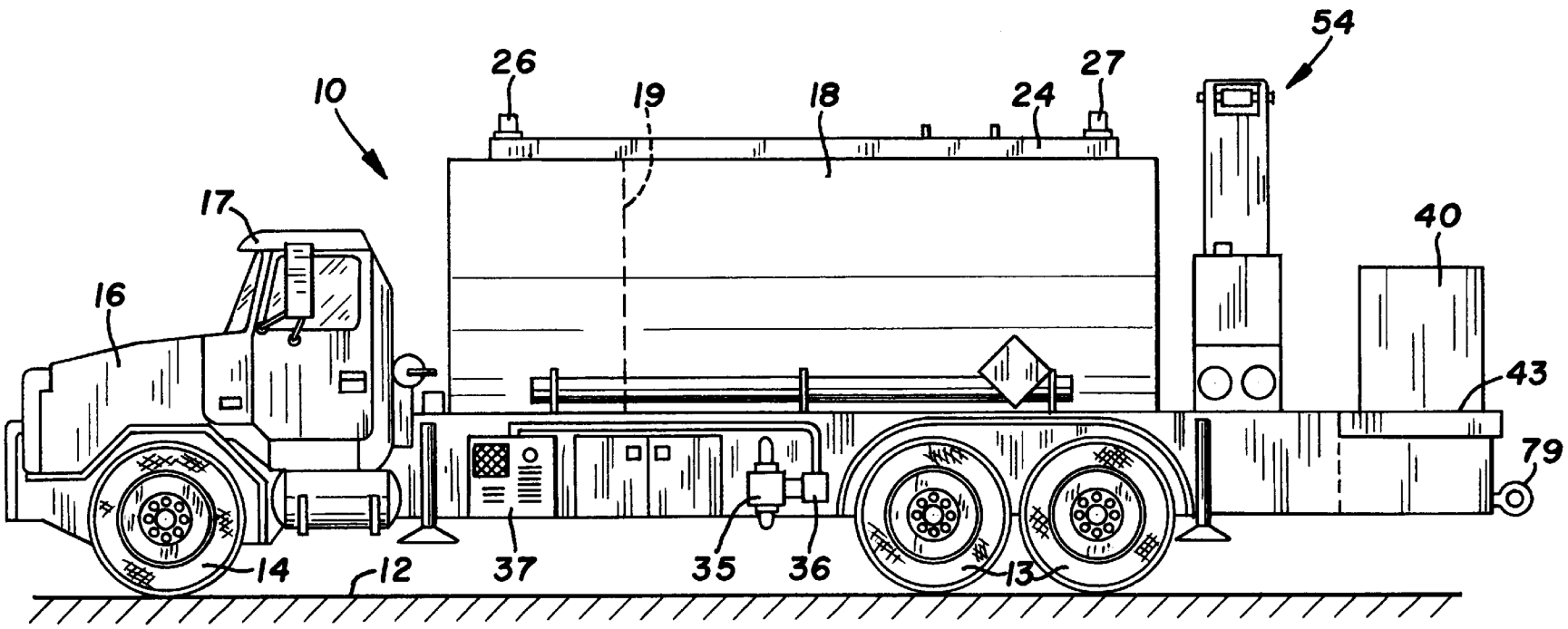
FIG. 2 is a left side elevation view thereof.

A rail locomotive service truck 10, shown in FIGS. 1 and 2, is a one stop service motor vehicle for providing fuel, oil, water, and sand to a rail locomotive in a remote location or rail year in a safe and environmentally effective manner. The locomotive is provided with operating products without the need to cut and run to a locomotive service pit. The cut and run practice is costly and time consuming. Truck 10 has a horizontal frame 11 supported on a roadway or ground 12 with dual drive wheels 13 and front steering wheels 14. The internal combustion engine of truck 10 is mounted on frame 11 under hood 16 in front of drivers cab 17. Frame 11, cab 17, engine, power transmission to drive wheels 13 and steering wheels 14 are conventional motor vehicle structures.

A cylindrical tank 18 mounted on frame 11 has an internal transverse divider 19 separating the inside of the tank into two separate chambers 21 and 22. Liquid fuel, such as No. 2 diesel fuel, is stored in chamber 21. Chamber 22 accommodates the same or a different grade of fuel. Both chambers 21 and 22 can be used to store liquid fuel for the internal combustion engine of a rail locomotive 30. A ladder 23 mounted on frame 11 adjacent a side of tank 18 is useable by a person to climb onto a catwalk 24 on top of tank 18. Strobe lights 26 and 27 are located at opposite ends of catwalk 24.

A fuel hose 28 wound on a reel 29 is used to carry fuel to the fuel tank of a rail locomotive 30. An example of hose 28 is a flexible cylindrical hose having a diameter of 2 inches and a length of 50 feet. Reel 29 is rotatably mounted within a housing 31 secured to a side of frame 11. A door (not shown) hinged to housing 31 closes the open side of housing 31 when hose 29 is wound on reel 29. A fuel totaling meter 32 located in housing 31 measures the amount of liquid fuel dispensed into the fuel tank of locomotive 30. A motor driven pump 35, shown in FIG. 2, draws liquid fuel from tank chamber 21 and discharges the fuel into hose 28. Pump 35 driven with a hydraulic motor 36 provides hydraulic fluid under pressure to tubular lines 38 joining pump 35 to motor 36. The controls for pump 35 are located on the panel of fuel meter 32 for convenient use by the work person. The controls are positioned in housing 31 as seen in FIG. 1. A nozzle 33 having an ON-OFF valve, shown in FIG. 3, attached to the remote end of hose 28 controls the dispensing of fuel into the fuel tank of locomotive 30. Nozzle 33 is operatively connected to an automatic shut off control 34 operable to terminate the flow of fuel in hose 28 when the fuel tank of the locomotive is full thereby preventing over fill-up of fuel and spillage into the environment. Oil spills clean up chemicals are stored in a container 81 mounted on truck frame 11. Chemical dispensing equipment associated with container 81 is used by the work person in the event fuel or oil is discharged into the environment to clean up the fuel or oil.

A first load valve 39 connected to a pipe 41 attached to frame 11 and joined to tank 18 is used to receive liquid fuel to fill tank chamber 21. A second drain valve 42 joined to pipe 41 is used to drain fuel from tank chamber 21 into a fuel storage tank or receiver for accommodating the fuel. Load and drain valves (not shown) are used to fill and drain fuel from tank chamber 22.

Figure 3:
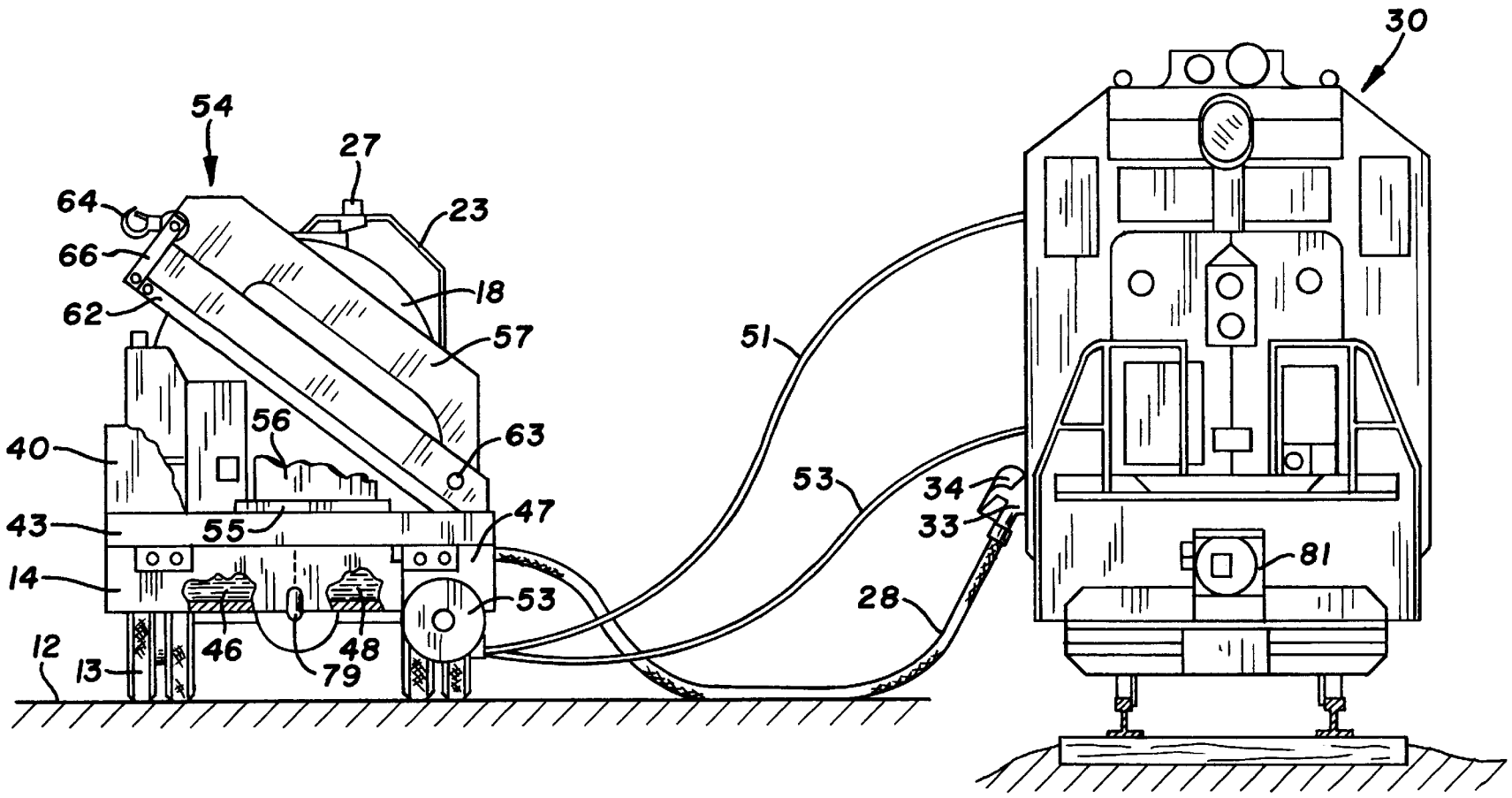
FIG. 3 is an end elevational view of the truck of FIG. 1 and a rail locomotive being serviced with fuel, oil, and water.

The rear of frame 11 supports a horizontal deck 43 useable to store sand bags or a container 40 accommodating sand. A pair of tanks 44 and 47 mounted on frame 11 are located below deck 43. Tanks 44 and 47 store oil 46 and water 48 for servicing locomotive 30. As shown in FIGS. 1 and 3, a first reel 49 rotatably mounted on frame 11 accommodates a hose 51 for carrying water from tank 47 to locomotive 30. A second reel 52 having hose 53 connected to tank 44 transfer oil from tank 44 to locomotive 30. Separate pumps (not shown) are used to move the water and oil from tanks 44 and 47 via hoses 51 and 53 to water and oil tanks on locomotive 30. When the water and oil dispensing operations are complete, hoses 51 and 53 are wound on reels 49 and 52.

Figure 4:
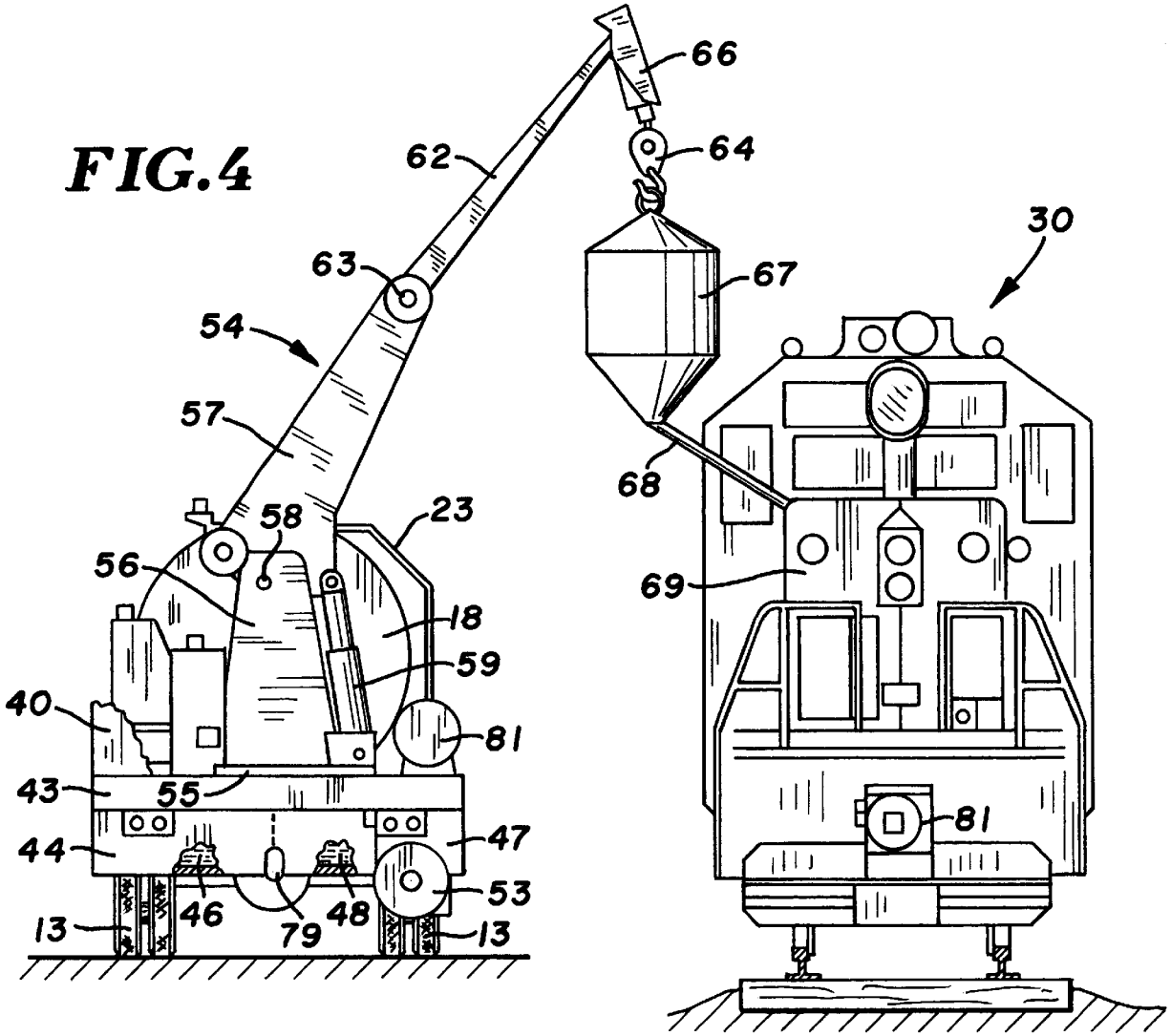
FIG. 4 is an end elevational view of the truck of FIG. 1 and a rail locomotive being serviced with sand.

As shown in FIG. 4, a hoist 54 has an upright standard 56 mounted on base 55 in front of deck 43. Base 55 secured to frame 11 supports standard 56 for movement about an upright axis to permit hoist 54 to swing from longitudinal to lateral positions. A first boom 57 pivoted at 58 to standard 56 is moved with a hydraulic cylinder 59 from a folded position to an upright position, seen in FIG. 4. A second boom 62 is articulately joined to the outer end of boom 57 with a connector 63 which allows boom 62 to be folded back against the boom 57. A hydraulic cylinder (not shown) can be used to control the position of boom 62 relative to extension 61. Second boom 62 can be constructed to telescopic into boom 57. Chain and hydraulic motor apparatus can be used to move boom 62 in and out of boom 57. A hydraulic cylinder connected to booms 57 and 62 can alternatively be used to move boom 62 to it's extended and retracted positions. A load hook 64 is supported with a coupling 66 on the outer end of boom 62. A sand bag or tank 67 connected to hook 64 is elevated from platform 43 above locomotive 30 to allow sand to flow from tank 67 through a tube 68 connected to the bottom of the bag to a sand hopper 69 on locomotive 30. When the sand dispensing operation is complete hoist 54 moves to a longitudinal position and sand tank 67 and tube 68 are lowered and stored on deck 43. Boom 62 is folded down adjacent boom 57 to its storage position, as seen in FIG. 3. The controls 71 for hoist 54 are mounted on frame 11 in a location for use by a work person.

Figure 5:
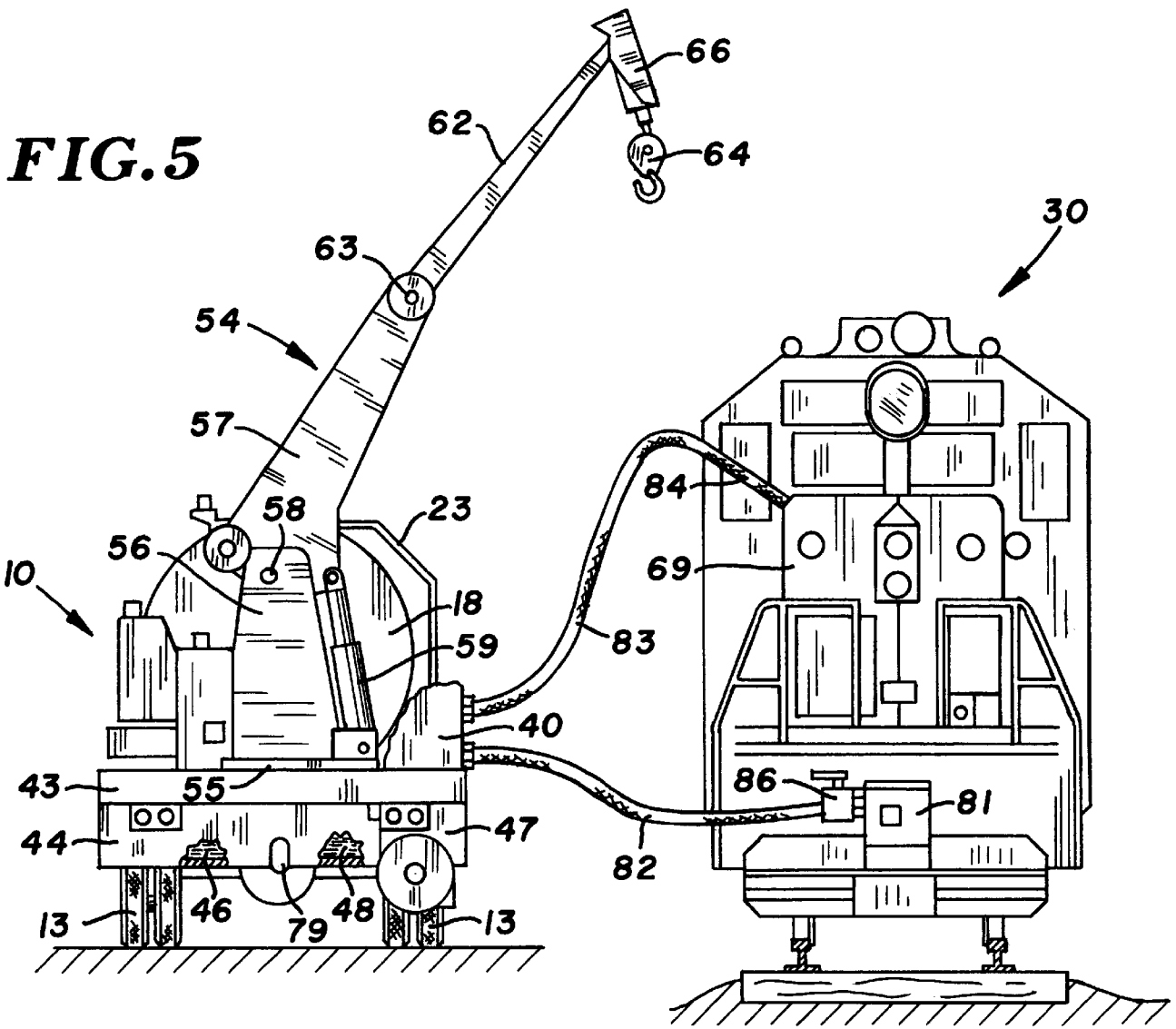
FIG. 5 is an end elevational view of the truck of FIG. 1 and a rail locomotive being serviced with sand with air under pressure from the locomotive.

As shown in FIG. 5, tank 67 is replaced with a tank 40 mounted on platform 43. Tank 40 is a closed container used to store sand and like particulates used by locomotive 30. The locomotive 30 has a large air compressor for supplying air pressure to the air brakes and other air operated equipment. A car coupling 81 on the front of locomotive 30 has an air outlet in communication with the air pressure system of locomotive 30. The air outlet is connected to an air hose 82 extended to sand tank 40. An air flow control valve 86 joined to hose 82 is used to regulate the flow of air into hose 82 and through tank 40. Air flowing in tank 40 picks up sand and moves the sand with air through a hose 83. Hose 83 has a tube 84 extended in sand hopper 69 so as to discharge sand into hopper 69. When the sand delivery operation is completed hoses 82 and 83 and valve 86 are uncoupled from locomotive 30 and stored on truck 10.

Figure 6:
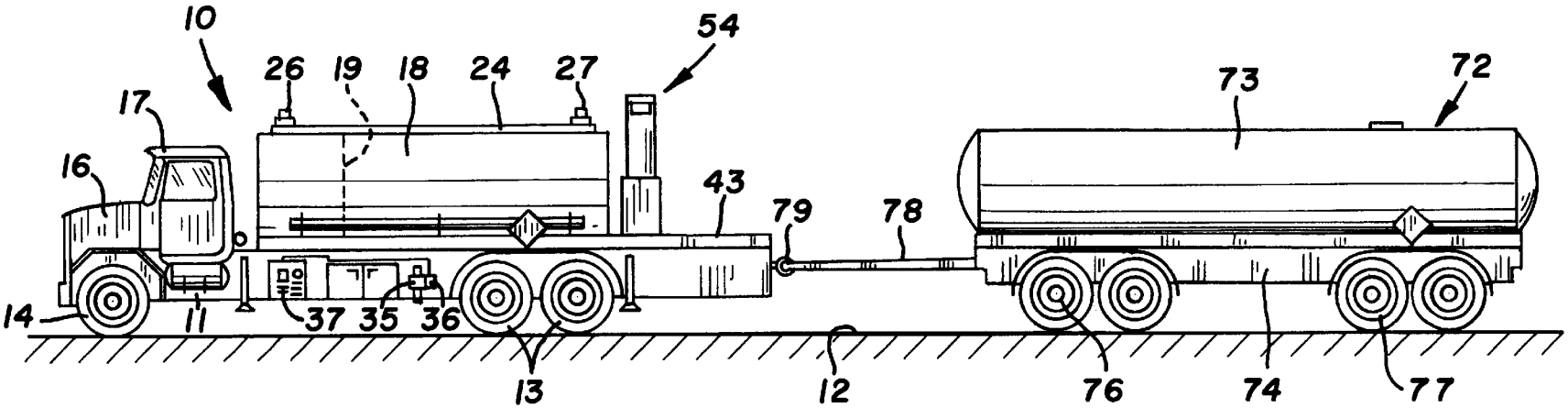
FIG. 6 is a side elevational view of the truck of FIG. 1 towing a tank trailer.

As shown in FIG. 6, a trailer 72 having an elongated tank 73 for carrying additional fuel for locomotive 30 is towed by truck 10. Trailer 72 has a frame 74 mounted on front and rear wheels 76 and 77. A tongue 78 coupled to frame 74 connects trailer 72 to the rear of truck frame 11. A hitch ring 79 secured to the back of frame 11 accommodates a device and pin on the tongue 78 to releaseable connect trailer 72 to truck 10. The pump 35 on truck 10 is used to move fuel from tank 73 to the fuel tank of locomotive 30. Trailer 72 can be used with a truck that does not have a fuel tank, such as tank 18. The fuel in tank 73 is used to provide fuel for locomotive 30. Alternatively, trailer 72 is used to provide additional amounts of fuel for servicing one or more locomotives in a remote location.

In use, the locomotive 30 is serviced with fuel, oil, water, and sand in a remote location to save time, labor, and cost. The truck 10 driven to the location of locomotive 30 has separate supplies of fuel, oil, water, and sand stored in tanks 18, 44, 47, and 67. As shown in FIG. 3, hose 28 extended between truck 10 and locomotive 30 transports fuel to locomotive 30. Hoses 51 and 53 are used to carry oil and water from truck 10 to locomotive 30. Hoses 28, 51, and 53 have sufficient length to traverse ditches and elevational grades. Pump 35 operates to move the fuel through hose 28 and nozzle 33 into the locomotive fuel tank. Nozzle 33 has an automatic shut-off mechanism that stops the flow of fluid through nozzle 33 when the locomotive fuel tank is full. Fuel is not allowed to spill onto roadway 12 or contaminate surrounding environment. Pump 35 has a bypass valve that opens, in response to fuel pressure and return the fuel back to tank 18. Other structures can be used to automatically terminate dispensing of fuel to locomotive 30 and shut down operation of pump 35. Separate hoses 51 and 53 extended from truck 10 to locomotive 30 carry oil and water from the oil and water tanks 46 and 48 to the oil and water tanks or diesel engine of locomotive 30. Separate pumps are individually operated to move the oil and water in oil and water lines 51 and 53.

The sand carried by truck 10 is transferred from truck platform 43 to sand hopper 69 with a hoist 54 or air line 83 in lieu of hoist 54. The sand tank or container 67 is elevated with hoist 54 to a location adjacent the side of the locomotive. The sand in tank 67 flows through pipe 68 into sand hopper 67. Hoist 54 can be used to shake tank 67 to ensure the gravity flow of sand from tank 67 to hopper 69. A hoist is used to return tank 67 to platform 43 upon completion of dispensing of sand to hopper 69. Hoist 54 is then returned to it's folded position adjacent the rear of tank 54. When the servicing of locomotive 30 is completed, the hoses 28, 51, and 53 are returned to their storage reels. The truck 10 is returned to the service depot. Locomotive 30 is ready to continue pulling the train since it has not been cut from the train.

Modifications in the structure of the locomotive servicing truck and method can be made by a person skilled in the art without departing from the invention. The invention is defined in the following claims.

What is claimed is:

1. A method of servicing a rail locomotive with fuel, water, oil and sand, said locomotive having a hopper for holding sand and a source of air under pressure comprising:

providing separate supplies of fuel, water, oil and sand;

simultaneously transporting with a single vehicle the separate supplies of fuel, water, oil and sand to a location adjacent the locomotive, said vehicle having a tank for storing sand;

dispensing fuel to the locomotive;

dispensing water to the locomotive;

dispensing oil to the locomotive; and moving sand from the vehicle to the locomotive with air flowing in hoses connected to the source of air under pressure on the locomotive, the tank on the vehicle storing sand, and the hopper on the locomotive receiving sand.

2. The method of claim 1 including: automatically terminating the flow of fuel to the locomotive when the locomotive fuel tank is full.

3. The method of claim 1 wherein: the separate supplies of fuel, water, and oil are stored in tanks mounted on a single motor vehicle.

4. The method of claim 1 wherein: the fuel is dispensed to the locomotive by pumping the fuel with a pump located on the vehicle.

5. The method of claim 1 wherein: the water is dispensed to the locomotive by pumping the water with a pump located on the vehicle.

6. The method of claim 1 wherein: the oil is dispensed to the locomotive by pumping the oil with a pump on the vehicle.

7. The method of claim 1 wherein: the fuel is dispensed to the locomotive by pumping the fuel with a first pump, the water is dispensed to the locomotive by pumping the water with a second pump, and the oil is dispensed to the locomotive with a third pump.

8. The method of claim 7 wherein: the first, second, and third pumps are mounted on the vehicle.

9. A method of servicing a rail locomotive with sand, said locomotive having a hopper for holding sand and a source of air under pressure comprising:

providing a vehicle having a tank for storing sand;

simultaneously transporting with said vehicle and a supply of sand in said tank to a location adjacent the locomotive; and moving sand from said tank on the vehicle to the hopper on the locomotive with air flowing in hoses connected to the source of air under pressure on the locomotive, the tank on the vehicle storing sand, and the hopper on the locomotive receiving sand.

10. The method of claim 9 wherein: the separate supplies of fuel, water, and oil are stored in tanks mounted on a single motor vehicle.

11. The method of claim 9 wherein: the fuel is dispensed to the locomotive by pumping the fuel with a pump located on the vehicle.

12. The method of claim 9 wherein: the water is dispensed to the locomotive by pumping the water with a pump located on the vehicle.

13. The method of claim 9 wherein: the oil is dispensed to the locomotive by pumping the oil with a pump on the vehicle.

14. The method of claim 9 wherein: the fuel is dispensed to the locomotive by pumping the fuel with a first pump, the water is dispensed to the locomotive by pumping the water with a second pump, and the oil is dispensed to the locomotive with a third pump.

15. An apparatus for servicing a rail locomotive with fuel, oil, water, and sand, said locomotive having a fuel tank for storing fuel, a source of air under pressure, and a hopper for holding sand, comprising:

a vehicle having a frame and wheels supporting the frame on a road surface, a first tank mounted on the frame for storing fuel for the locomotive, a second tank mounted on the frame for storing oil for the locomotive, a third tank mounted on the frame for storing water for the locomotive, a container for storing sand supported on the frame, pump means for pumping fuel, oil, and water from the first, second and third tanks to the locomotive, and means for moving sand from the container to the hopper on the locomotive including a first hose for carrying air under pressure from the source of air under pressure on the locomotive to the container and a second hose for carrying air and sand from the container to the hopper on the locomotive.

16. The apparatus of claim 15 including: means in the first tank dividing the tank into two chambers for storing fuels for the locomotive.

17. A vehicle for servicing a rail locomotive with fuel, oil, water, and sand, said locomotive having a fuel tank for storing fuel, a source of air under pressure, and a hopper for storing sand, comprising: a motor truck having a frame and wheels supporting the frame on a road surface, a first tank mounted on the frame for storing fuel for the locomotive, a second tank mounted on the frame for storing oil for the locomotive, a third tank mounted on the frame, pump means on the truck for pumping fuel, oil, and water from the first, second and third tnaks to the locomotive, and means for moving sand from the container to the hopper on the locomotive including a first hose for carrying air under pressure from the source of air under pressure on the locomotive to the container and a second hose for carrying air and sand from the container to the hopper on the locomotive.

18. The vehicle of claim 17 including: means in the first tank dividing the tank into two chambers for storing fuels for the locomotive.

* * * * *